United States Patent [19]

Denney et al.

[11] 4,189,137

[45] Feb. 19, 1980

[54] VACUUM PICKUP DEVICE

[75] Inventors: General C. Denney, Manhattan, Kans.; John Lenz, Lindenhurst, Ill.; Joseph M. Williams, Manhattan, Kans.

[73] Assignee: The McCall Pattern Company, New York, N.Y.

[21] Appl. No.: 896,459

[22] Filed: Apr. 14, 1978

[51] Int. Cl.[2] ..... B65H 3/08; B66C 1/02

[52] U.S. Cl. ..... 271/103; 294/64 R; 414/121; 414/752

[58] Field of Search ..... 294/64 R, 65; 214/1 BS, 214/1 BT, 6 FS, 8 SD; 269/21; 271/90, 91, 94, 102, 103, 104, 107, 108; 414/121, 752

[56] References Cited

U.S. PATENT DOCUMENTS

| | | | |
|---|---|---|---|
| 1,717,454 | 6/1929 | Kelly | 271/103 |
| 2,563,450 | 8/1951 | Battey | 271/103 |
| 2,879,994 | 3/1959 | Cote | 271/103 X |
| 2,976,037 | 3/1961 | Seel et al. | 271/103 |
| 2,995,359 | 8/1961 | Gulick | 271/103 |
| 3,000,629 | 9/1961 | Spiess | 271/103 |
| 3,430,949 | 3/1969 | Herdeg et al. | 271/103 X |
| 3,702,698 | 11/1972 | Schwebel | 271/103 |

FOREIGN PATENT DOCUMENTS

| | | | |
|---|---|---|---|
| 1098011 | 1/1961 | Fed. Rep. of Germany | 271/103 |
| 310860 | 10/1971 | U.S.S.R. | 294/64 R |

OTHER PUBLICATIONS

*Weightless Probe for Chip Picking,* W. G. Thomson, IBM Technical Disclosure Bulletin, vol. 16, No. 11, Apr. 1974, pp. 3651–3652.

*Primary Examiner*—Johnny D. Cherry
*Attorney, Agent, or Firm*—Ronald A. Schapira

[57] ABSTRACT

A vacuum pickup device which includes:

(1) a tubular outer member having one of its ends open and one of its ends sealed and having one or more ports, between its ends, that provide communication between its interior and exterior and that are in communication with a source of vacuum;

(2) a tubular inner member, positioned within the outer member and extending outwardly of the outer member through its open end; the inner member having one or more ports, between its ends, that provide communication between its interior and exterior; the inner member also being adapted to move through the open end of the outer member, between an extended position, in which an open end of the inner member extends a predetermined maximum distance outwardly of the open end of the outer member, and a retracted position, in which the open end of the inner member extends less than the predetermined maximum distance outwardly of the open end of the outer member; and (3) a spring, adapted to urge the inner member from its retracted position to its extended position.

In the extended position of the inner member, its ports are located between the ports in the outer member and the open end of the outer member but are not in communication with the ports in the outer member, and in the retracted position of the inner member, its ports are in communication with the ports in the outer member.

15 Claims, 5 Drawing Figures

VACUUM PICKUP DEVICE

BACKGROUND OF THE INVENTION

This invention relates to a vacuum pickup device which operates in a relatively simple manner and which has relatively few parts. This invention particularly relates to a vacuum device which becomes operable, only upon its contacting an object that is to be picked up. This invention quite particularly relates to a vacuum device for picking up a sheet of material, especially a thin sheet of material, from a stack.

Heretofore, there have been many designs for a device to pick up an object, such as a sheet of material, by suction. In general, such a vacuum pickup device has been designed with an open end which does the actual picking up of the object. The open end of the vacuum pickup device typically has been connected to a source of vacuum, to make the device operable, just after the object, being picked up, covers the open end of the device. As a result, a vacuum pickup device generally has had to be provided with rather sophisticated controls for timing the connection of the source of vacuum to the open end of the device.

Frequently, materials handling equipment, provided with a plurality of such vacuum devices, has been used for picking up objects of varying sizes. However, a significant problem has arisen in the use of such equipment for picking up a relatively small object, which does not cover the open ends of all of the vacuum pickup devices of the equipment. In particular, the open ends of vacuum devices, which have not been covered by a relatively small object, being picked up, have drawn in air and thereby rendered the equipment inoperable for picking up the object. As a result, the uncovered open ends of vacuum devices in such equipment have had to be manually sealed before picking up a relatively small object.

In order to avoid the need for manually sealing the open ends of vacuum pickup devices, a design for a vacuum pickup device has been sought, in which a source of vacuum, connected to the device to make it operable, is not in communication with the open end of the device, unless the open end of the device is covered by the object to be picked up.

SUMMARY OF THE INVENTION

In accordance with the invention in this application, a vacuum pickup device is provided, comprising:

a generally tubular, outer member having one of its ends open and one of its ends sealed and having a port, between it ends, that provides communication between its interior and exterior;

a generally tubular, inner member, positioned within the outer member and extending outwardly of the outer member through the open end of the outer member; the inner member having a port, between its ends, that provides communication between its interior and exterior; the inner member also being adapted to move through the open end of the outer member, between an extended position, wherein an open end of the inner member extends a predetermined maximum distance outwardly of the open end of the outer member, and a retracted position, wherein the open end of the inner member extends less than the predetermined maximum distance outwardly of the open end of the outer member;

means for urging the inner member from its retracted position to its extended position; and means for connecting a source of vacuum to the port of the outer member;

the port in the inner member and the port in the outer member being located, so that (1) in the extended position of the inner member, the port in the inner member is located between the port in the outer member and the open end of the outer member but is not in communication with the port in the outer member and (2) in the retracted position of the inner member, the port in the inner member is in communication with the port in the outer member.

By this invention, a vacuum pickup device is provided, in which a source of vacuum, connected to the device to make it operable, is not in communication with the open end of the device, that does the actual picking up, until the open end of the device is covered by, and is retracted in relation to, an object to be picked up. Also by this invention, a vacuum pickup device is provided which is particularly well suited for picking up a sheet of material from a stack.

BRIEF DESCRIPTION OF THE DRAWINGS

In FIG. 1, an open end of a tubular inner member of the device extends a predetermined maximum distance outwardly of an open end of a tubular outer member of the device.

In FIG. 2, the inner member has been retracted somewhat from its position in FIG. 1, so that its open end extends less than the predetermined maximum distance outwardly of the open end of the outer member and so that ports in the inner and outer members are in communication.

DETAILED DESCRIPTION OF THE INVENTION

Figure 1:
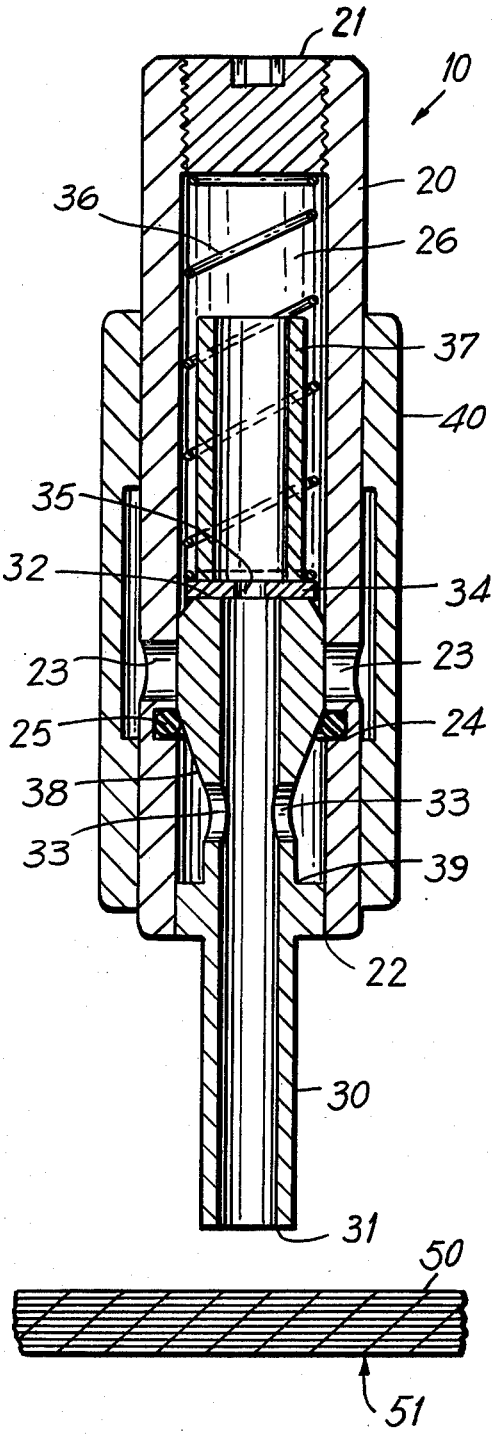
FIG. 1 is a schematic sectional view of a vacuum pickup device in accordance with this invention.

The vacuum pickup device, generally 10, of this invention and its operation are schematically shown in FIGS. 1 to 5.

As seen from FIGS. 1 to 5, the vacuum pickup device 10 includes a generally tubular, outer member 20. One end, preferably the upper end 21, of the outer member 20 is sealed air-tight, and the other end, preferably the lower end 22, is open. One or more ports 23, e.g., two ports 23, are provided between the ends 21 and 22 of the outer member 20. The ports 23 comprise conventional holes or bores in the outer member 20, which provide communication between the exterior and the hollow interior of the outer member 20. Preferably, the ports 23 have a substantially radial orientation in the outer member 20 and are circumferentially spaced about the outer member 20.

As also seen from FIGS. 1 to 5, the vacuum pickup device 10 includes a generally tubular, inner member 30. The inner member 30 is positioned within the outer member 20. One end 31 of the inner member 30 is open and extends outwardly of the outer member 20, through the open end 22 of the outer member 20. The open end 31 of the inner member 30 constitutes the open end of the vacuum device 10, which does the actual picking up of an object. A conventional suction cup (not shown) can, if desired, be placed over the open end 31 of the inner member 30. The other end 32 of the inner member 30 is positioned within the outer member 20 and is also open. It is preferred that the end 32 of the inner member 30, within the outer member 20, be beveled to facilitate its insertion in the open end 22 of the outer member 20 during the assembly of the vacuum pickup device 10. One or more ports, e.g., two ports 33, are provided in the inner member 30, between its ends 31 and 32. The ports 33 comprise conventional bores or holes in the inner member 30, providing communication between the exterior and the hollow interior of the inner member 30. It is preferred that the ports 33 have a substantially radial orientation in the inner member 30 and be circumferentially spaced about the inner member 30.

The inner member 30 of the vacuum pickup device 10 is adapted to closely fit within the hollow interior of the outer member 20, preferably so that the interior of the outer member 20 is substantially air-tight. The inner member 30 also is adapted to move within the outer member 20 and along the axis thereof. Hence, it is preferred that the exterior surface of the inner member 30 and the interior surface of the outer member 20 be as smooth as possible, so that the exterior surface of the inner member 30 can slide easily along the interior surface of the outer member 20. It is also preferred that the axis of the inner member and the axis of the outer member coincide.

Figure 2:
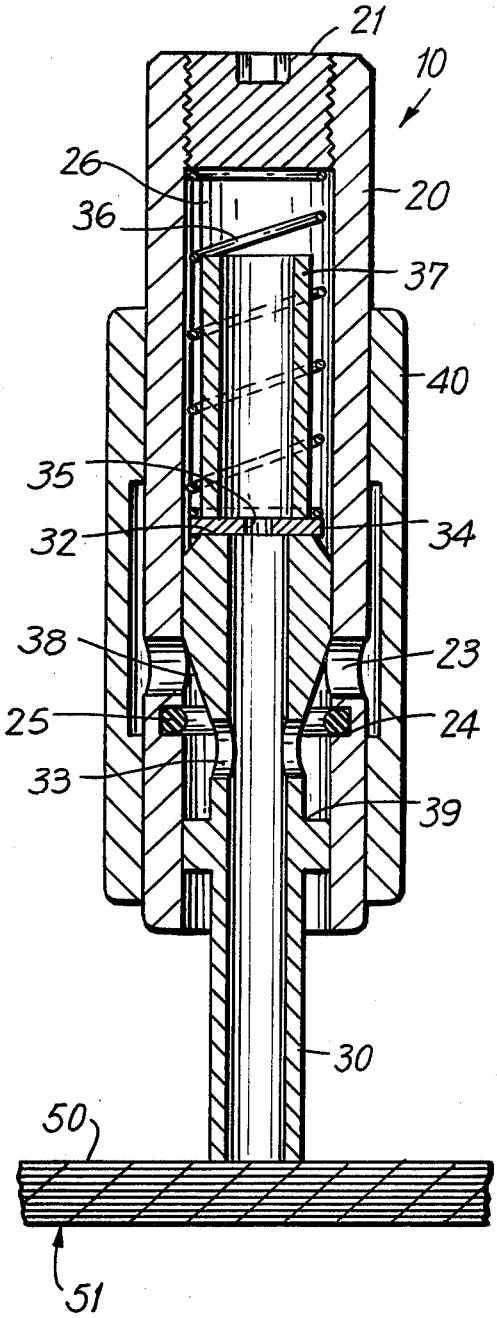
FIG. 2 is a schematic sectional view of the vacuum pickup device, in which the open end of the inner member of the device is being urged against the top sheet of a stack of materials, to be picked up, so that the open end of the inner member is covered by, and is retracted in relation to, the top sheet.

The inner member 30 of the vacuum pickup device 10 is also adapted to move through the open end 22 of the outer member 20 between an extended position and one or more retracted positions relative to the open end 22 of the outer member 20. Shown in FIG. 1 is the inner member 30 in its extended position. FIG. 2 shows the inner member 30 in a partially retracted position, and FIG. 3 shows the inner member 30 in a fully retracted position.

Figure 3:
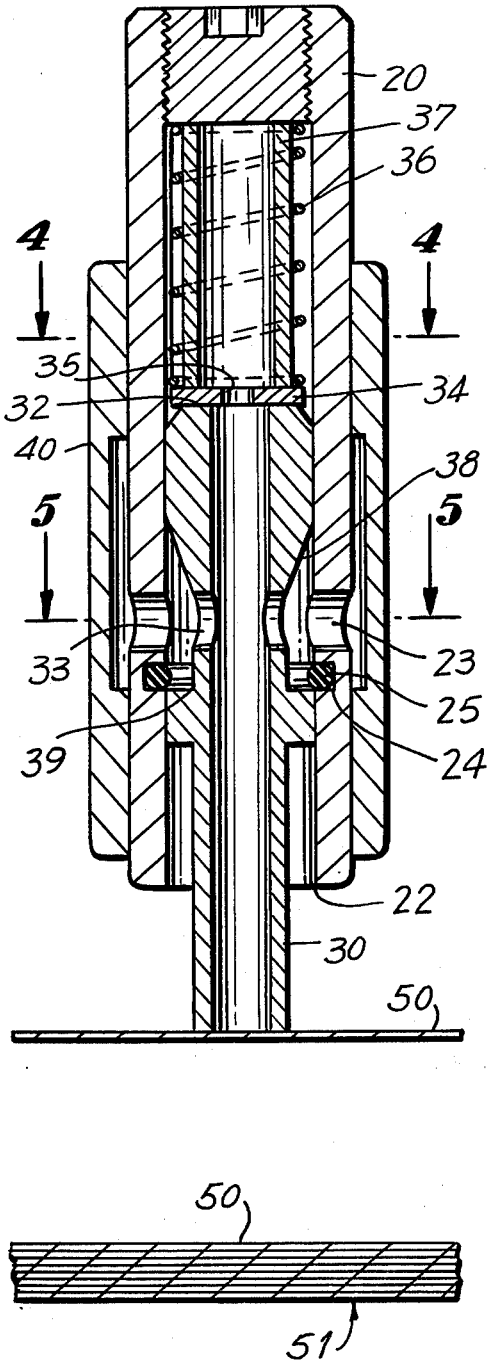
FIG. 3 is a schematic sectional view of the vacuum pickup device, in which the top sheet of material has been lifted from the stack and the inner member has been retracted further from its position in FIG. 1, so that its open end extends a predetermined minimum distance outwardly of the open end of the outer member.
Figure 4:
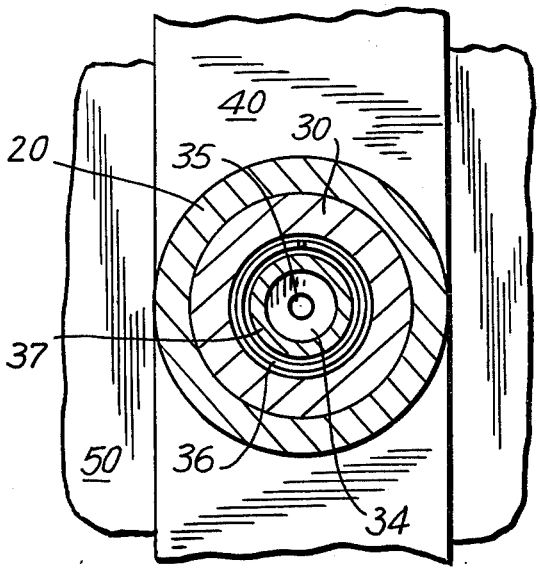
FIG. 4 is a schematic sectional view, taken along line 4—4 in FIG. 3.

As schematically shown in FIGS. 1 to 3 and as discussed hereinafter, the open end 31 of the inner member 30, in the extended and retracted positions of the inner member 30, preferably extends downwardly from the open end 22 of the outer member 20. However, the particular direction in which the open end 31 of the inner member 30 extends outwardly of the open end 22 of the outer member 20 in the vacuum pickup device 10 of this invention is not critical to the operation of the device 10.

In the extended position of the inner member 30, as shown in FIG. 1, its open end 31 extends a predetermined maximum distance outwardly of the open end 22 of the outer member 20. The specific predetermined maximum distance, which the open end 31 of the inner member 30 extends outwardly of the outer member 20, is not critical but rather essentially depends upon the specific configurations and dimensions of the elements of the vacuum pickup device 10.

As further seen from FIGS. 1 to 4, the beveled end 32 of the inner member 30, within the outer member 20, is provided with a generally round disc 34. The disc 34 has a somewhat larger diameter than the beveled end 32 of the inner member 30 and preferably has a diameter that is almost equal to the inside diameter of the outer member 20. The disc 34 of the inner member 30 includes an axially extending port 35 therein. The port 35 of the disc 34 is adapted to connect the hollow interior of the inner member 30 with a cavity 26 in the interior of the outer member 20, between the disc 34 of the inner member 30 and the sealed end 21 of the outer member 20. The disc 34 rests on the beveled end 32 of the inner member 30 but is not affixed to the beveled end of the inner member.

As still further seen from FIGS. 1 to 4, the inner member 30 also is provided with a generally tubular spring 36. The spring 36 is positioned within the cavity 26 of the outer member 20, between the disc 34 of the inner member 30 and the sealed end 21 of the outer member 20. The spring 36 has its axis substantially aligned with the axis of the outer member 20. Spring 36 is adapted to push the disc 34, and thereby push the beveled end 32 of the inner member 30, away from the sealed end 21 of the outer member 20. As a result, the spring 36 serves to hold the disc 34 on the beveled end 32 of the inner member 30 and to urge the inner member 30 from its fully retracted position as shown in FIG. 3 to its extended position as shown in FIG. 1. The spring 36 is designed, so that the force, which it exerts on the inner member 30, is less than any suction forces, exerted on the inner member 30, when an object, being picked up, covers the open end 31 of the inner member 30.

As yet further seen from FIGS. 1 to 4, the inner member 30 also is provided with a generally tubular spacer 37. The spacer 37 is positioned within the cavity 26 of the outer member 20, between the disc 34 of the inner member 30 and the sealed end 21 of the outer member 20. The axis of the spacer 37 is aligned with the axis of the outer member 20. The spacer 37 can be provided about the spring 36 but is preferably provided within the spring 36. The spacer 37 has a length equal to the distance between the disc 34 and the interior surface of the sealed end 21 of the outer member 20 when the inner member 30 is in its fully retracted position as shown in FIG. 3. As a result, in the fully retracted position of the inner member 30, the spacer 37 contacts both the disc 34 and the sealed end 21 of the outer member 20 and thereby serves to assure that the open end 31 of the inner member 30 will extend at least a predetermined minimum distance outwardly of the open end 22 of the outer member 20. While particular dimensions of the spacer 37 are not critical, it is preferred that the outside diameter of the spacer 37 be sufficiently small, so that the spacer 37 can move freely along the axis of the outer member 20, within the closed end 26 of the outer member 20 and within the spring 36. It is also preferred that the outside diameter of the spacer 37 and the length of the spacer 37 be sufficiently large, so that the spacer can move within the outer member 20 and the spring 36 without danger that the axis of the spacer 37 will become misaligned relative to the axes of the outer member 20 and the spring 36.

As also shown in FIGS. 1 to 5, the vacuum pickup device 10 includes a hollow member or bar 40, in which the outer member 20 is mounted. The hollow bar 40 is adapted to be connected to a conventional source of vacuum (not shown) that provides a partial vacuum within the hollow bar 40. The hollow bar 40 encloses the portions of the outer member 20, in which its ports 23 are located. As a result, the bar 40 can serve as a means for connecting a source of vacuum to the ports 23 of the outer member 20. Preferably, the bar 40 comprises a hollow metal tube, such as a steel tube, in which each outer member 20 of a plurality of vacuum pickup devices 10 can be mounted for use in picking up objects of varying dimensions. However, the use of the bar 40 is not critical, and the bar can, if desired, be replaced in the vacuum pickup device 10 by any conventional means for connecting a source of vacuum to the ports 23 of the outer member 20.

In the vacuum pickup device 10 of this invention, particular configurations and dimensions of the hollow bar 40, the outer member 20 and the inner member 30, including its disc 34, spring 36, and spacer 37, are not critical. Likewise, these parts of the vacuum pickup device 10 can be suitably made from a wide variety of conventional metals, such as copper, steel and aluminum, and plastics, such as polyvinylchloride, polyethylene, nylon and fiberglass.

However, it is preferred that the exterior surface portions of the inner member 30 be provided with a first, generally annular cutout 38, extending upwardly from the ports 33 in the inner member 30 towards its beveled end 32, within the outer member 20. The principal purpose of the first cutout 38 in the inner member 30 is to provide communication between the ports 23 and 33 in the outer and inner members 20 and 30 when such ports 23 and 33 are in close proximity but are not radially aligned, as in the partially retracted position of the inner member 30, shown in FIG. 2. However, particular configurations and dimensions of the first cutout 38 are not critical. The first cutout 38 is preferably beveled from the top of the ports 33 of the inner member 30. In this regard, the angle of the beveled first cutout 38, with respect to the top of the ports 33, is not critical, although an angle of about 30° has been found suitable for the first cutout 38.

Also in the vacuum pickup device 10 of this invention, means should be provided to prevent the open end 31 of the inner member 30 from extending further than the predetermined maximum distance outwardly of the open end 22 of the outer member 20 in the extended position of the inner member 30 as shown in FIG. 1. For this purpose, conventional means, such as stops, can be placed at the open end 22 of the outer member 20. However, it is preferred that the means for preventing the open end 31 of the inner member 30 from extending more than the predetermined maximum distance outwardly of the open end 22 of the outer member 20 comprise: a second, generally annular cutout 24 in the interior surface portions of the outer member 20, below the ports 23 therein; and a generally annular O-ring or the like 25, mounted in the second cutoff 24 and adapted to engage the surface of the first cutout 38 in the inner member 30 above the ports 33 therein. In this regard, the specific dimensions, placements and configurations of the second cutout 24 and the O-ring 25 of the outer member 20 are not critical. Likewise, the selection of the material of the O-ring 25 is not critical, and any conventional elastomeric material, such as a synthetic or natural rubber, can be utilized. Preferably, the O-ring 25 has an inside diameter somewhat less than the maximum diameter, but greater than the minimum diameter, of the first cutout 38 in the inner member 30. It is also preferred that the second cutout 24 be placed just beneath the ports 23 in the outer member 20 but not in communication with the ports 23. Providing the O-ring 25 with such an inside diameter allows the O-ring 25 to securely grip the surface of the first cutout 38 in the inner member 30, above the ports 33 therein, in the extended position of the inner member 30 as shown in FIG. 1. Thereby, the O-ring 25 serves to restrain the inner member 30 from further movement outwardly of the outer member 20 beyond the extended position of the inner member, but the O-ring 25 does not unduly interfere with axial movement of the inner member 30 inwardly of the outer member 20, to the retracted positions of the inner member 30 as shown in FIGS. 2 and 3. By placing the second cutout 24 beneath, but not in communication with, the ports 23, the O-ring 25 also helps to prevent communication between the ports 23 and 33 in the extended position of the inner member 30.

Further in the vacuum pickup device 10 of this invention, a third, generally annular cutout 39 is preferably provided in the exterior surface of the inner member 30, extending downwardly from the ports 33 in the inner member 30 towards its open end 31, outside of the outer member 20. The principal purpose of the third cutout 39 in the inner member 30 is to provide communication between the ports 23 and 33 in the outer and inner members 20 and 30 when such ports are in close proximity but are not radially aligned, as in the fully retracted position of the inner member 30, shown in FIG. 3. The third cutout 39 also serves to accomodate the O-ring 25 in the fully retracted position of the inner member 30 as shown in FIG. 3, so that the O-ring 25 does not grip the exterior surface portions of the inner member 30 beneath its ports 33. However, particular dimensions and configurations of the third cutout 39 are not critical.

In the partially retracted position of the inner member 30, as shown in FIG. 2, its open end 31 extends outwardly of the open end 22 of the outer member 20 by a predetermined distance. This predetermined distance is such that: (1) the ports 23 in the outer member 20 are in communication with the ports 33 in the inner member 30; and (2) the spacer 37 does not touch both the disc 34 of the inner member 30 and the sealed end 21 of the outer member 20. Moreover, this predetermined distance is less than the predetermined maximum distance that the open end 31 of the inner member 30 extends outwardly of the open end 22 of the outer member 20 in the extended position of the inner member 30 as shown in FIG. 1.

In the fully retracted position of the inner member 30, as shown in FIG. 3, its open end 31 extends outwardly of the open end 22 of the outer member 20 by a predetermined minimum distance. This predetermined minimum distance is such that: (1) the ports 23 and 33 in the outer and inner members 20 and 30 are in communication; and (2) the spacer 37 is held by disc 34 against the sealed end 21 of the outer member 20. Moreover, this predetermined minimum distance is less than the predetermined distance that the open end 31 of the inner member 30 extends outwardly of the open end 22 of the outer member 20 in the partially retracted position of the inner member as shown in FIG. 2.

However, in accordance with this invention, specific distances, over which the open end 31 of the inner member 30 extends outwardly of the open end 22 of the outer member 20 in the partially and fully retracted positions of the inner member 30 as shown in FIGS. 2 and 3, are not critical. Rather, such distances essentially depend upon the specific dimensions and configurations of the elements of the vacuum pickup device 10 of this invention.

Also in accordance with this invention, particular quantities, sizes, orientations and locations of the ports 23 and 33 are not critical. Nevertheless, the relative positions of the ports 33 in the inner member 30 and the ports 23 in the outer member 20 are very important. In this regard, it is essential in the vacuum pickup device 10 that, in the extended position of the inner member 30 as shown in FIG. 1, the ports 33 in the inner member 30 be between the ports 23 in the outer member 20 and the open end 22 of the outer member 20. Also, it is essential that, in the extended position of the inner member 30, the ports 23 and 33 in the outer and inner members 20 and 30 not be in communication. As seen from FIG. 1, this result is principally achieved by covering the interior of the ports 23 of the outer member 20 with the exterior surface portions of the inner member 30, above the first cutout 38 in the inner member 30, in the extended position of the inner member. As also seen from FIG. 1, the engagement of the O-ring 25 with the surface of the first cutout 38 also serves to prevent communication, e.g., air leakage, between the ports 23 and 33 in the extended position of the inner member.

Figure 5:
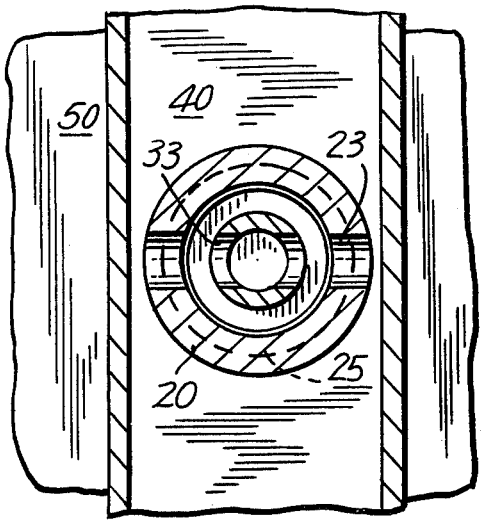
FIG. 5 is a schematic sectional view, taken along line 5—5 in FIG. 3.

It is further essential that, in the partially retracted position of the inner member 30, as shown in FIG. 2, and in the fully retracted position of the inner member 30, as shown in FIG. 3, the ports 33 in the inner member 30 be in communication with the ports 23 in the outer member 20. Such communication can be established in the partially and fully retracted positions of the inner member 30 by: (1) providing the ports 23 and 33 in the outer and inner members 20 and 30 with sufficiently large dimensions; and (2) aligning the ports 23 and 33, i.e., providing each port 23 of the outer member 20 with the same angular position, about the common axes of the outer and inner members 20 and 30, as a port 33 of the inner member 30; whereby at least portions of the ports 23 and 33 are open and connected to each other in both the partially retracted and fully retracted positions of the inner member 30. However, in accordance with the preferred device 10 of this invention, communication between the ports 23 and 33 of the outer and inner members 20 and 30 is attained in the partially and fully retracted positions of the inner member 30, as shown in FIGS. 2 and 3, without the need to provide the ports 23 and 33 of the outer and inner members 20 and 30 with large dimensions or to align the ports of the outer and inner members. Rather, in the partially retracted position of the inner member 30, as shown in FIG. 2, such communication preferably is achieved, at least in part, by providing the first, generally annular cutout 38 in the exterior of the inner member 30, extending upwardly from the ports 33 of the inner member, so that portions of the ports 23 in the outer member 20 are aligned with portions of the first cutout 38 and are open and connected to the port 33 in the inner member 30 through the first cutout 38. Moreover, in the fully retracted position of the inner member 30, as shown in FIGS. 3 and 5, communication between the ports 23 and 33 in the outer and inner members 20 and 30 preferably is achieved, at least in part, by providing the third, generally annular cutout 39 in the exterior of the inner member 30, extending downwardly from the ports 33 in the inner member, so that portions of the ports 23 in the outer member 20 are aligned with portions of the third cutout 39 and are open and connected to the ports 33 in the inner member 30 through the third cutout 39.

In the operation of the vacuum pickup device 10 of this invention wherein, for example, an object, such as a sheet 50 of material, is picked up from the top of a stack of sheets 51, the inner member 30 of the device is initially in its extended position as shown in FIG. 1. In this position, the open end 31 of the inner member 30 extends the predetermined maximum distance outwardly of the open end 22 of the outer member 20. The inner member 30 is prevented from extending further outwardly of the outer member 20 than the predetermined maximum distance by the O-ring 25 which grips the surface of the first cutout 38 in the exterior of the inner member 30 and thereby opposes any gravitational forces and forces exerted by spring 36, urging the inner member outwardly of the outer member. Also in the extended position of the inner member 30, communication between the ports 33 in the inner member 30 and the ports 23 in the outer member 20 is obdurated by the exterior surface portions of the inner member 30 above its first cutout 38. As a result, a vacuum source (not shown), which is in communication with the hollow bar 40 and the ports 23 in the outer member 20, is not in communication with the ports 33 in the inner member 30, the interior of the inner member 30 or the open end 31 of the inner member.

As a first step in picking up the top sheet 50 from the stack 51, the vacuum pickup device 10 is urged, preferably downwardly, against the top sheet 50, so that the open end 31 of the inner member 30 is forcibly pressed against the top sheet 50 and the open end 31 of the inner member 30 is tightly covered by the top sheet 50. This forces the inner member 30 to move axially within the outer member 20, towards the sealed end 21 of the outer member 20 and into the partially retracted position of the inner member 30 within the outer member 20 as shown in FIG. 2. In this position, the open end 31 of the device 10 is retracted in relation to the top sheet 50. As a result of this step, communication is established automatically between the vacuum source and the hollow interior and open end 31 of the inner member 30, via the hollow bar 40, the ports 23 in the outer member 20, the first cutout 38 in the inner member 30, and the ports 33 in the inner member 30. Such communication between the vacuum source and the interior of the inner member 30 causes a partial vacuum to be formed in the interior of the inner member 30 and thereby causes the top sheet 50 to be tightly held, by suction, to the open end 31 of the inner member 30. This step, in which the inner member 30 of the vacuum pickup device 10 is partially retracted by pushing its open end 31 against the top sheet 50, also causes the disc 34 on the beveled end 32 of the inner member 30 to further compress the spring 36 against the sealed end 21 of the outer member 20. In addition, this step causes the interior of the cavity 26 of the outer member 2, above the inner member 30, to be placed in communication with the vacuum source, via the port 35 in disc 34, and a partial vacuum is created in the cavity 26.

As the next step in picking up the top sheet 50 from the stack 41 with the vacuum pickup device 10, the inner member 30, holding by suction the sheet 50 over its open end 31, is moved axially within the outer member 20 and closer to the sealed end 21 of the outer member 20, so that the inner member 30 is in its fully retracted position within the outer member 20 as shown in FIG. 3. This movement of the inner member 30 to its fully retracted position is caused by the partial vacuum, formed in the cavity 26 of the outer member 20 when the interior of the inner member 30 and the cavity 26 are placed in communication with a source of vacuum via the ports 23 and 33. In the fully retracted position of the inner member 30, the disc 34 on the inner member holds the spacer 37 against the sealed end 21 of the outer member 20, and as a result, the open end 31 of the inner member 30 is prevented by the spacer 37 from retracting further and thereby extending less than the predetermined minimum distance outwardly of the open end 22 of the outer member 20. Also in this position, the ports 23 and 33 in the outer and inner members 20 and 30 are in direct communication and/or in communication via the third cutout 39 in the inner member 30.

The vacuum pickup device 10 is adapted to have the movement of the inner member 30 from its partially retracted position to its fully retracted position within the outer member 20 be an automatic and relatively abrupt or sudden movement. In the device 10, such abrupt movement of the inner member 30 to its fully retracted position is particularly effective for separating the top sheet 50 from the rest of the stack of the sheets 51. This effect can be achieved with the device when picking up a wide variety of sheet materials, such as paper, cloth and plastic, whether flexible or rigid, and is especially important when picking up relatively thin sheet materials.

After the inner member 30 of the vacuum pickup device 10 has been fully retracted with the top sheet 50, as shown in FIG. 3, the device 10 can be used to convey the sheet to a location where the sheet can undergo further processing. At such a location, the sheet can be easily removed from the open end 31 of the device 10. For example, sheet 50 can be removed from the device simply by relieving the vacuum in the interior of the hollow bar 40, so as to relieve the vacuum in the interior of the outer and inner members 20 and 30. Relieving the vacuum in the outer and inner members 20 an 30 removes the suction holding the sheet 50 to the open end 31 of the inner member 30, so that the sheet 50 can be transferred, without hindrance, from the device 10. Relieving the vacuum in the outer and inner members 20 and 30 also allows the inner member 30 to be pushed by the spring 36, acting against the disc 34 and along the axis of the outer member 20, so that the inner member 30 returns to its extended position with respect to the outer member 20 as shown in FIG. 1. After the inner member 30 has been urged by the spring 36 back to its extended position, as shown in FIG. 1, the vacuum in the hollow bar 40 can be reestablished, and the vacuum pickup device 10 is then ready to be used again to pick up another sheet 50 of material from the top of the stack 51. Alternatively, the sheet 50 can be forcibly removed from the open end 31 of the device, so that the vacuum in the interior of the inner member 30 is relieved and the inner member 30 is urged by spring 36 to its extended position.

In the operation of the vacuum pickup device 10, the provision and relief of the partial vacuum in the hollow bar 40, in which the outer member 20 is mounted, and the movement of the vacuum pickup device relative to the stack 51 of sheet materials, in order to effect pickup of individual sheets from the stack, can be regulated in a conventional manner by the use of simple cams, timers, or other devices for synchronizing manufacturing processes.

The vacuum pickup device 10 of this invention, despite its relatively simple operation and design, provides significant advantages in the vacuum pickup of sheet materials and the like. In particular, the open end 31 of the inner member 30 of the device 10 of this invention, which does the actual picking up, is not in communication with a source of vacuum until the open end 31 of the device is covered by, and is retracted in relation to, a sheet of material 50 being picked up, i.e., when the open end 31 of the device is forcibly pressed against the sheet 50 that is to be picked up. Because the open end 31 of the device 10 is not in communication with the source of vacuum until the open end is covered by, and is retracted in relation to, the material being picked up, special means need not be provided to coordinate: (1) the contacting of the open end of the device with the material being picked up; and (2) the actuation of the source of vacuum. Moreover, because of the automatic abrupt retraction of the inner member 30 of the device 10 to its fully retracted position ater a material, being picked up, has been held by suction to the partially retracted open end 31 of the device 10, the operation of the device aids in separating a sheet of material from any sheets beneath it.

In accordance with this invention, the terms "generally tubular", "generally annular" and "generally round", as applied to the outer and inner members 20 and 30 of the vacuum pickup device 10, as well as the O-ring 25, disc 34, spring 36, cutouts 24, 38 and 39, and spacer 37 of the outer and inner members 20 and 30, encompass members of circular cross sections, as well as other cross sections, such as elliptical and polygonal, e.g., square, pentagonal, octagonal, etc. In this regard, the particular cross sectional configurations of the "generally tubular", "generally annular" and "generally round" elements of the vacuum pickup device 10 are not considered critical, so long as these elements are compatible and are adapted: (1) to be closely fit together in sliding relationship and, where desirable, in substantially air-tight relationship; and (2) to cooperate to provide a vacuum pickup device which will operate as described above.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the form hereinbefore described being merely a preferred embodiment thereof.

We claim:

1. A vacuum pickup device, comprising:

a generally tubular, outer member having one of its ends open and one of its ends sealed and having a port, between its ends, that provides communication between its interior and exterior;

a generally tubular, inner member, positioned within the outer member and extending outwardly of the outer member through the open end of the outer member; the inner member having a port, between its ends, that provides communication between its interior and exterior; the inner member also being adapted to move through the open end of the outer member, between an extended position, wherein an open end of the inner member extends a predetermined maximum distance outwardly of the open end of the outer member, and a retracted position, wherein the open end of the inner member extends less than the predetermined maximum distance outwardly of the open end of the outer member;

means for urging the inner member from its retracted position to its extended position; and means for connecting a source of vacuum to the port of the outer member;

the port in the inner member and the port in the outer member being located, so that (1) in the extended position of the inner member, the port in the inner member is located between the port in the outer member and the open end of the outer member but is not in communication with the port in the outer member and (2) in the retracted position of the inner member, the port in the inner member is in communication with the port in the outer member.

2. The device of claim 1 wherein a first, generally annular cutout is provided in the exterior surface portions of the inner member, extending from the port therein towards the end thereof, within the outer member.

3. The device of claim 2 wherein the inner member is adapted to move between the extended position and a partially retracted position; and wherein the first cutout provides communication between the ports of the outer and inner members in the partially retracted position of the inner member.

4. The device of claim 3 wherein a second, generally annular cutout is provided in the exterior surface portions of the inner member, extending from the port therein towards its open end, outside of the outer member.

5. The device of claim 4 wherein the inner member is adapted to move between the partially retracted position and a fully retracted position, in which the open end of the inner member extends outwardly of the open end of the outer member a predetermined minimum distance; and wherein the second cutout provides communication between the ports of the outer and inner members in the fully retracted position of the inner member.

6. The device of claim 5 wherein a generally annular O-ring is mounted in the interior of the outer member, between its port and its open end, and the O-ring is adapted to engage the surface of the first cutout in the inner member in the extended position of the inner member.

7. The device of claim 6 wherein the first cutout in the inner member is beveled from the port in the inner member.

8. The device of claim 7 wherein a generally tubular spacer is provided between the sealed end of the outer member and the end of the inner member, within the outer member; the axis of the spacer being aligned with the axis of the outer member; and the spacer having a length equal to the distance between the end of the inner member, within the outer member, and the sealed end of the outer member in the retracted position of the inner member.

9. The device of claim 8 wherein a generally tubular spring is provided about the spacer; the spring being adapted to urge the end of the inner member, within the outer member, away from the sealed end of the outer member and to urge the inner member from its retracted position to its extended position.

10. The device of claim 9 wherein the end of the inner member, within the outer member, includes a generally round disc, having a larger diameter than the end of the inner member, within the outer member.

11. The device of claim 2 wherein a generally annular O-ring is mounted in the interior of the outer member, between its port and its open end, and the O-ring is adapted to engage the surface of the first cutout in the inner member in the extended position of the inner member.

12. The device of claim 11 wherein the first cutout in the inner member is beveled from the port in the inner member.

13. The device of claim 1 wherein a generally tubular spacer is provided between the sealed end of the outer member and the end of the inner member, within the outer member; the axis of the spacer being aligned with the axis of the outer member; and the spacer having a length equal to the distance between the end of the inner member, within the outer member, and the sealed end of the outer member in the retracted position of the inner member.

14. The device of claim 13 wherein the end of the inner member, within the outer member, includes a generally round disc, having a larger diameter than the end of the inner member, within the outer member.

15. The device of claim 13 wherein a generally tubular spring is provided about the spacer; the spring being adapted to urge the end of the inner member, within the outer member, away from the sealed end of the outer member and to urge the inner member from its retracted position to its extended position.

* * * * *

UNITED STATES PATENT AND TRADEMARK OFFICE

CERTIFICATE OF CORRECTION

PATENT NO. : 4,189,137

DATED : February 19, 1980

INVENTOR(S) : General C. Denney et al

It is certified that error appears in the above-identified patent and that said Letters Patent are hereby corrected as shown below:

at column 5, line 56, "cutoff" should be -- cutout -- ;

at column 6, line 29, "accomodate" should be -- accommodate -- ;

at column 8, line 55, "2" should be -- 20 -- ;

at column 8, line 60, "41" should be -- 51 -- ;

at column 9, line 37, "an" should be -- and -- ;

at column 10, line 17, "ater" should be -- after -- ;

Signed and Sealed this

*Sixteenth* Day of *September 1980*

[SEAL]

*Attest:*

SIDNEY A. DIAMOND

*Attesting Officer*

*Commissioner of Patents and Trademarks*